US007102585B2

(12) United States Patent
Hsiu et al.

(10) Patent No.: US 7,102,585 B2
(45) Date of Patent: Sep. 5, 2006

(54) INTEGRATED FEED HORN DEVICE

(75) Inventors: Huang-Chang Hsiu, Taipei Hsien (TW); Jan-Cheng Geng, Taipei Hsien (TW); Lai-Chung Min, Taipei Hsien (TW)

(73) Assignee: Wistron NeWeb Corp., Taipei Hsien (TW)

( * ) Notice: Subject to any disclaimer, the term of this patent is extended or adjusted under 35 U.S.C. 154(b) by 52 days.

(21) Appl. No.: 10/999,472

(22) Filed: Nov. 29, 2004

(65) Prior Publication Data

US 2006/0050004 A1 Mar. 9, 2006

(30) Foreign Application Priority Data

Sep. 7, 2004 (TW) ..... 93126965 A

(51) Int. Cl.
*H01Q 13/00* (2006.01)

(52) U.S. Cl. ..... 343/786; 343/772

(58) Field of Classification Search ..... 343/786, 343/772

See application file for complete search history.

(56) References Cited

U.S. PATENT DOCUMENTS

| | | | | |
|---|---|---|---|---|
| 6,313,808 | B1 * | 11/2001 | Yuanzhu | 343/786 |
| 6,388,633 | B1 * | 5/2002 | Imaizumi et al. | 343/776 |
| 6,720,932 | B1 * | 4/2004 | Flynn et al. | 343/786 |
| 7,002,528 | B1 * | 2/2006 | Moheb | 343/781 R |
| 2005/0237239 | A1 * | 10/2005 | Kuo et al. | 343/700 MS |

* cited by examiner

*Primary Examiner*—Don Wong
*Assistant Examiner*—Binh Van Ho
(74) *Attorney, Agent, or Firm*—J.C. Patents

(57) ABSTRACT

An integrated feed horn device including three sets of integrally formed feed horn devices is provided. The integrated feed horn device may receive satellite signals reflected by a single parabolic reflector antenna, wherein the satellite signals are transmitted by three satellites separated by small angles. The integrated feed horn device may comprise a first waveguide, a second waveguide and a third waveguide, wherein the first waveguide, the second waveguide and the third waveguide may be adopted for receiving a first satellite signal, a second satellite signal, and a third satellite signal. Each of the satellite signals described above is transmitted by different satellites.

6 Claims, 2 Drawing Sheets

INTEGRATED FEED HORN DEVICE

CROSS-REFERENCE TO RELATED APPLICATION

This application claims the priority benefit of Taiwan application serial no. 93126965, filed on Sep. 7, 2004.

BACKGROUND OF THE INVENTION

1. Field of the Invention

The present invention relates to a feed horn device. More particularly, the present invention relates to an integrated feed horn device for receiving satellite signals transmitted from three satellites separated by small angles.

2. Description of Related Art

Recently, as the space technology advances, satellites are adopted for signal transmission. Since the coverage area for signal transmission via the satellite is very broad and the propagation path thereof is not easily influenced by the topography of the receiver, the satellite communication technology has gradually become the main stream of the communication technology. In general, the purpose of satellite is very broad and may be applied in, for example, military, meteorology, direct broadcast program and internet, wherein satellite direct broadcast system and internet are very suitable for household requirement. Therefore, the development of domestic satellite antenna has become more important and popular.

In general, synchronous satellite orbits the earth synchronously with the rotation of the earth. Therefore, the satellite may be provided as a relay station for signal transmission when the transmitters on the ground transmit signals between each other via the satellite. The signal is carried by radio wave transmitted from the transmitter to the satellite, and then the satellite transmits the signal which is carried by another radio wave, which is received by a parabolic reflector antenna of a receiver device on the ground.

For example, in the United States of America, the image signal of the satellite direct broadcast program carried by a circular polarization wave is transmitted to the viewer via the DBS satellite in longitude 119° W recently. In addition, the two-way transmission of the internet signal is performed via the FSS satellite in longitude 116.8° W, wherein the radio wave used to carry the internet signal is a linear polarization wave. Thus, the angle between these two satellites is very small (about 2.2°). Therefore, the feed angle of the two signals is very close. Generally, the satellite direct broadcast program and internet are the most popular household communication source of external information. Conventionally, an integrated feed horn device that can receive two radio waves from two satellites separated with a small angle has been developed, wherein two sets of feed horn devices are integrated in a single parabolic reflector antenna. Therefore, two conventional parabolic reflector antennas may be instead with a feed horn device to receive two signals from two satellites.

However, as the requirement of information communication advances, the amount of the satellites increased rapidly, therefore, the angle between every satellites are reduced rapidly. In addition, the receiver device is required to simultaneously receive a plurality of signals of every satellite. Presently, a receiver device is not capable of receiving three signals from three satellites separated by small angles since the angles between every satellites are small so that the intervals between every feed horn devices for each satellite is small. Therefore, three sets of conventional feed horn devices can not be integrated in a single parabolic reflector antenna to simultaneously receive three signals, and thus three parabolic reflector antennas are required for simultaneously receiving three signals from three satellites respectively. Thus, the conventional technology is not only expensive but also the plurality of parabolic reflector antennas occupies a large space.

SUMMARY OF THE INVENTION

Therefore, the present invention is related to an integrated feed horn device, in which three set feed horn devices are integrated for receiving the satellite signals transmitted by three satellites separated by small singles reflected by a parabolic reflector antenna. Therefore, the need of a plurality of conventional parabolic reflector antennas for receiving the satellite signals transmitted by three satellites separated by small angles can be effectively eliminated.

According to one embodiment of the present invention, an integrated feed horn device comprising three sets of integrally formed feed horn devices is provided. The three sets integrally formed feed horn devices may be adopted for receiving the satellite signals transmitted by three satellites separated by small singles reflected by a parabolic reflector antenna. The integrated feed horn device may comprise a first waveguide, a second waveguide and a third waveguide, wherein the first waveguide, the second waveguide and the third waveguide may be adopted for receiving a first satellite signal, a second satellite signal, and a third satellite signal. Each of the satellite signals described above is transmitted by a different satellite. Moreover, the three set waveguides described above are arranged in a row and parallel to each other, and the second waveguide is located in between the first and third waveguides.

According to one embodiment of the present invention, the integrated feed horn device may comprise at least three circular feed horns with each circular feed horn comprising a corrugation module for restraining the high order mode satellite signal. The corrugation module may comprise a plurality of arc shaped metal plate structures, wherein the arc shaped metal structures may be gradually sunk from an edge to a center thereof, and the outer side of the arc shaped metal plate structures has a gap directing towards the second waveguide. Moreover, the arc shaped metal plate structure of the second feed horn device may comprise a radius larger than the radius of the arc shaped metal plate structure of the first or third feed horn devices.

According to one embodiment of the present invention, the integrated feed horn device may comprise an elliptical feed horn comprising a corrugation module for restraining the high order mode satellite signal. The corrugation module may comprise a plurality of arc shaped metal plate structures, wherein the arc shaped metal plate structures may be arranged from an edge towards a center thereof.

Accordingly, the present invention provides an integrated feed horn device comprising three sets of feed horn devices integrated in a small feed spacing for receiving satellite signals transmitted by three satellites separated by small angles reflected by a single parabolic reflector antenna. Therefore, need for a plurality of conventional parabolic reflector antennas for receiving the satellite signals transmitted by three satellites separated by small angles could be effectively avoided.

One or part or all of these and other features and advantages of the present invention will become readily apparent to those skilled in this art from the following description wherein there is shown and described one embodiment of this invention, simply by way of illustration of one of the modes best suited to carry out the invention. As it will be realized, the invention is capable of different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

The present invention now will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
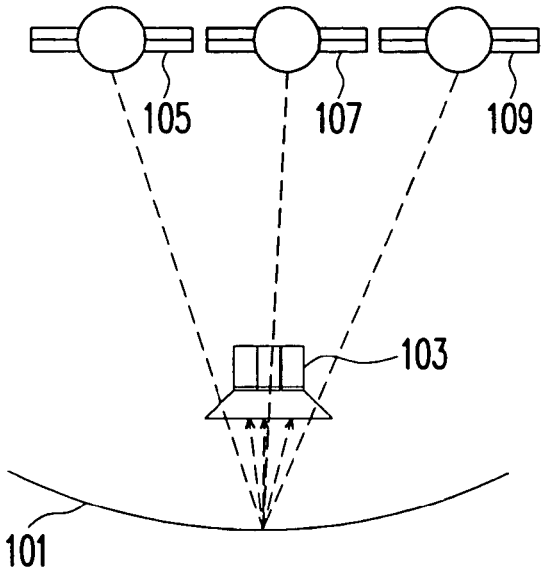
FIG. 1 is a schematic view illustrating an integrated feed horn device receiving satellite signals according to one embodiment of the present invention.

FIG. 1 is a schematic view illustrating an integrated feed horn device receiving satellite signals according to one embodiment of the present invention. Referring to FIG. 1, the present invention provides a parabolic reflector antenna 101 for receiving the signals transmitted from the satellites 105, 107 and 109, wherein the signals are reflected by the reflection plane of the parabolic reflector antenna 101 to integrated feed horn device 103. The integrated feed horn device 103 comprises a first feed horn device, a second feed horn device and a third feed horn device for receiving signals transmitted from the satellites 105, 107 and 109 respectively.

Conventionally, when the parabolic reflector antenna 101 is adopted for receiving the satellite signals, the angle of the signals reflected by the reflection plane of parabolic reflector antenna 101 have to be optimized. Particularly, when the satellites are very close to each other (i.e., the interval between the satellites are very small), signals may interfere with each other. According to an embodiment of the present invention, each set of feed horn device of the integrated feed horn device 103 is capable of precisely receiving satellite signals even when the intervals between the satellites 105, 107 and 109 are very small.

Figure 2:
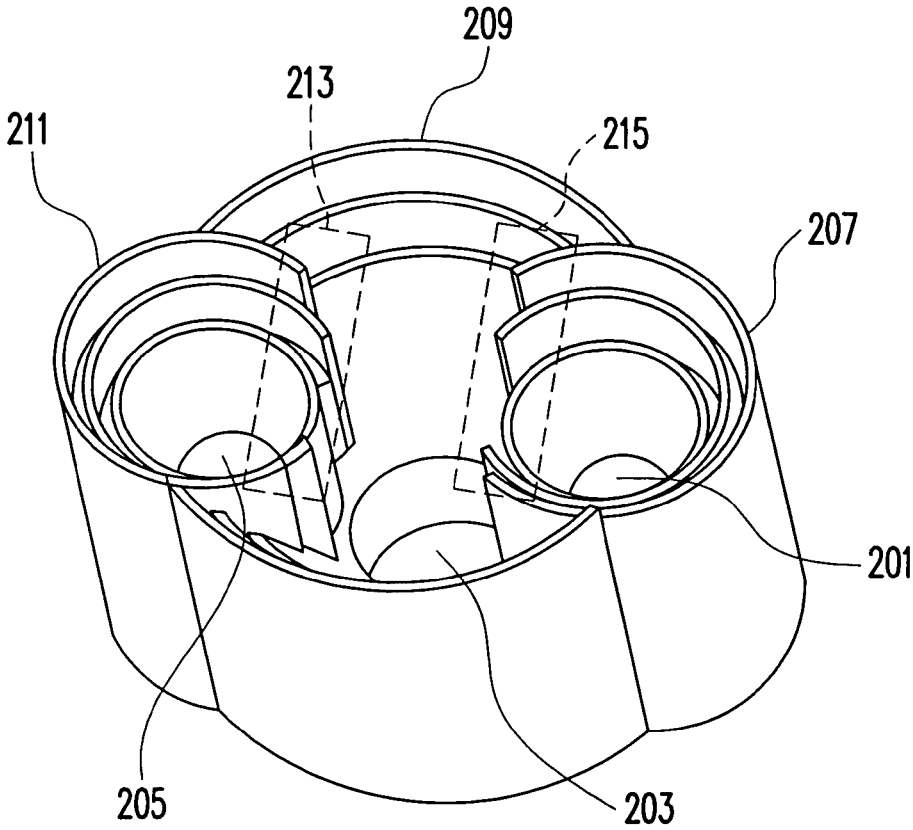
FIG. 2 is a schematic view of an integrated feed horn device having a circular opening according to one embodiment of the present invention.

FIG. 2 is a schematic view of an integrated feed horn device comprising a circular opening according to one embodiment of the present invention. Referring to FIG. 2, three circular waveguides 201, 203 and 205 are integrated, wherein a set of corrugation module devices 207, 209 and 211 are disposed around the outside of each waveguides 201, 203 and 205. The corrugation module devices 207, 209 and 211 may be adopted for restraining the generation of the high order mode of the electric field. Therefore, the feed pattern generated by the integrated feed horn device may be smooth and symmetrical and can fit the requirement of the users. It is noted that, the size and shape of the feed pattern are limited by the feed horn device for generating the feed pattern respectively, wherein the feed pattern corresponding to the surface of the horn may be adjust to fit the size and position of the surface of the horn to obtain a preferred feed power of the horn. In the present embodiment, each of the corrugation module devices 207, 209 and 211 described above may comprise a plurality of arc shaped metal plate structures, wherein the arc shaped metal plate structures may be arranged from an edge of the integrated feed horn device to a center thereof as shown in FIG. 2.

In the present embodiment, since the three circular feed horn are arranged close to each other, the position of the opening of the middle waveguide 203 is limited by the space, and thus requires a specific corrugation module in the horizontal direction for revising the feed pattern. In order to reduce this problem, corrugation module 207 and 211 of the circular waveguide 201 and 205 are arranged with a gap 213 and 215 respectively, directed towards the circular waveguide 203. In addition, the radius of the arc plate shaped metal structure of the corrugation module 209 of the circular waveguide 203 is larger than that of the corrugation modules 207 and 211 of the circular waveguides 201 and 205 respectively. The arc shaped metal plate structure of the corrugation module 209 of the circular waveguide 203 is disposed over that of the corrugation modules 207 and 211 of the circular waveguides 201 and 205 respectively.

Therefore, the two sides of the corrugation modules 207 and 209 have to be integrated with the central feed horn. In addition, the position of the gaps 213 and 215 of the corrugation module 207 and 209 may also be provided for adjusting the feed pattern and the circular polarization of each circular waveguide. Therefore, the problem described above can be effectively reduced. In addition, in the present embodiment, when the satellite signal received by the integrated feed horn device is a circular polarization signal, a polarizer may be further mounted in the feed horn device for converting the circular polarization signal into a linear polarization signal.

Figure 3:
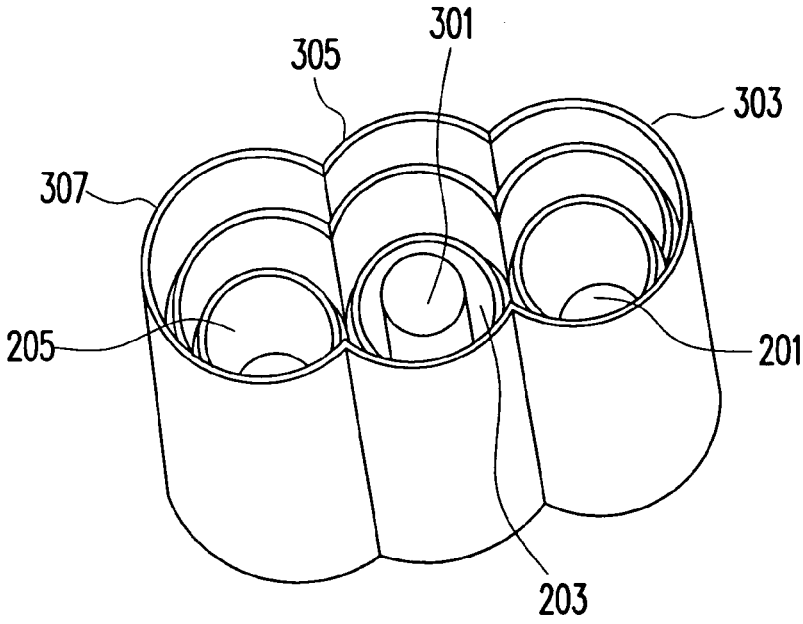
FIG. 3 is a schematic view of an integrated feed horn device having a circular opening according to another embodiment of the present invention.

FIG. 3 is a schematic view of an integrated feed horn device comprising a circular opening according to another embodiment of the present invention. Referring to FIG. 3, as shown in FIG. 1, the circular feed horn 201, 203 and 205 comprise corrugation modules 303, 305 and 307 respectively for restraining the generation of the high order mode of the electric field. In order to reduce the space of the three circular feed horns, the shape of the corrugation module 305 of the circular feed horn 203 is different from the corrugation module 209 shown in FIG. 2. In one embodiment of the present invention, in order to restrain the high order mode of the electric field in the shape of the corrugation module 305 more completely, a rod antenna 301 may also be disposed in the opening of the circular feed horn 203 to revise the feed pattern of the satellite signal received by the circular feed horn 203.

Figure 4:
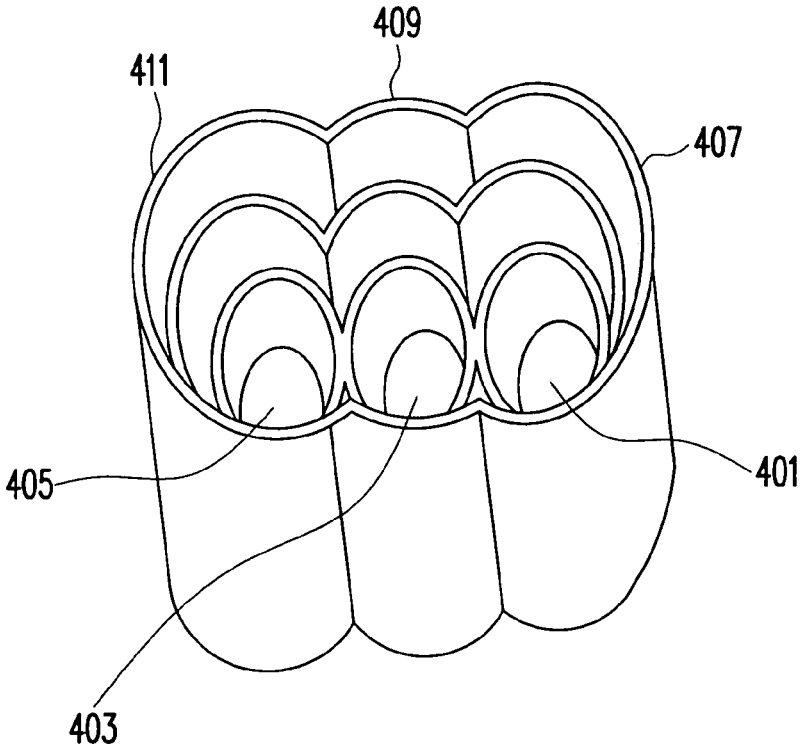
FIG. 4 is a schematic view of an integrated feed horn device having an elliptical opening according to another embodiment of the present invention.

FIG. 4 is a schematic view of an integrated feed horn device comprising an elliptical opening according to another embodiment of the present invention. Referring to FIG. 4, three feed horns 401, 403 and 405 of the integrated feed horn device may comprise elliptical opening. In addition, as the embodiments shown in FIG. 2 and FIG. 3, corrugation module devices 407, 409 and 411 of the present embodiment are disposed around the elliptical feed horns 401, 403 and 405 respectively to restrain the generation of the high order mode of the electric field.

In the present embodiment, the shape of the corrugation devices 407, 409 and 411 may have similar or identical to that of the corrugation modules 303, 305 and 307 shown in FIG. 3. In general, since the conventional feed horn for simultaneously receiving a plurality of satellite signals has an elliptical reflective surface, the elliptical feed horn device of the present embodiment may be readily applied in the conventional feed horn to obtain an excellent feed pattern and performance. Therefore, it is not necessary to dispose a rod antenna in the middle elliptical feed horn 403 of the integrated feed horn device.

In another embodiment of the present invention, when the integrated feed horn device with an elliptical opening is provided for receiving circular polarization signal, a phase difference of the electric field in the vertical direction may be generated due to the length of the major axis and the length of the minor axis of the elliptical opening are not the same. Accordingly, the performance of the polarizer is reduced. Therefore, a phase compensation device has to be disposed between the elliptical feed horn and polarizer to compensate the phase difference, or a non-perpendicular polarizer may be adopted for revising the phase difference due to the difference of the length between the major and minor axis.

Accordingly, the integrated feed horn device of the present invention provides three sets of feed horn devices that are integrated in a small feed spacing for receiving satellite signals transmitted by three satellites separated by small angles reflected by a single parabolic reflector antenna. Therefore, the need of a plurality of conventional parabolic reflector antennas for receiving the satellite signals transmitted by three satellites separated by small angles can be effectively eliminated.

The foregoing description of the embodiment of the present invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. An integrated feed horn device, comprising:

a first waveguide, for receiving a first satellite signal;

a second waveguide, for receiving a second satellite signal; and a third waveguide, for receiving a third satellite signal;

wherein the first, second and third are integrally formed with as single unit and are arranged in a row and parallel to each other, the second waveguide is located in between the first and third waveguides, and the first, second and third waveguides comprise a circular feed horn that comprises a corrugation module for restraining a signal of the satellite signal, wherein the corrugation module comprises a plurality of arc shaped metal plate structures.

2. The integrated feed horn device of claim 1, wherein the arc shaped metal plate structures are arranged from an edge towards a center thereof.

3. The integrated feed horn device of claim 1, wherein an arc shaped metal plate structures of the corrugation module of the first waveguide and the third waveguide comprises a gap directed towards the second waveguide.

4. The integrated feed horn device of claim 3, wherein a radius of the arc shaped metal plate structures of the second waveguide is larger than a radius of the arc shaped metal plate structures of the first waveguide or the third waveguide.

5. An integrated feed horn device, comprising:

a first waveguide, for receiving a first satellite signal;

a second waveguide, for receiving a second satellite signal; and a third waveguide, for receiving a third satellite signal;

wherein the first, second and third are integrally formed with as single unit and are arranged in a row and parallel to each other, the second waveguide is located in between the first and third waveguides, the first, second and third waveguides comprise an elliptical feed horn that comprises a corrugation module for restraining a signal of the satellite signal, wherein the corrugation module comprises a plurality of arc shaped metal plate structures.

6. The integrated feed horn device of claim 5, wherein the arc shaped metal plate structures are arranged from an edge towards a center thereof.

* * * * *

UNITED STATES PATENT AND TRADEMARK OFFICE

CERTIFICATE OF CORRECTION

PATENT NO. : 7,102,585 B2
APPLICATION NO. : 10/999472
DATED : September 5, 2006
INVENTOR(S) : Huang-Chang Hsiu et al.

It is certified that error appears in the above-identified patent and that said Letters Patent is hereby corrected as shown below:

Title Page, please correct inventors' name on item (75) as HUANG, CHANG-HSIU; JAN, CHENG-GENG and LAI, CHUNG-MIN Signed and Sealed this Seventeenth Day of June, 2008

JON W. DUDAS
*Director of the United States Patent and Trademark Office*